United States Patent [19]

Mudgett

[11] Patent Number: 4,966,638

[45] Date of Patent: Oct. 30, 1990

[54] SILICONE MIXTURE AND METHOD OF USING IT

[75] Inventor: Donald Mudgett, Coopersville, Mich.

[73] Assignee: Lestox, Inc., Birmingham, Mich.

[21] Appl. No.: 365,748

[22] Filed: Jun. 13, 1989

[51] Int. Cl.[5] ..... H01B 13/06

[52] U.S. Cl. ..... 156/51; 156/80; 174/110 S; 524/445

[58] Field of Search ..... 156/51, 52, 80; 174/110 S; 524/445, 448

[56] References Cited

U.S. PATENT DOCUMENTS

| | | | |
|---|---|---|---|
| 3,445,420 | 5/1969 | Kookootsedes et al. | 525/478 X |
| 4,011,168 | 3/1977 | Uhlmann | 174/110 S X |
| 4,202,812 | 5/1980 | Murray | 524/448 |

*Primary Examiner*—Robert A. Dawson

*Attorney, Agent, or Firm*—Dykema Gossett

[57] ABSTRACT

An improved silicone mixture is disclosed that is abrasion resistant and more durable than prior silicone compounds. A silicone rubber is combined with clay and, optionally, a quantity of powdered alumina-trihydrate may be added to provide fire resistance. The silicone rubber may be either a liquid silicone rubber, or, in a second embodiment a vulcanizing silicone rubber. The final mixture is arrived at by distinct methods depending on the type of silicone rubber that is utilized. A method of disposing mixture upon an electric cable to create an insulation outer coating for the electric cable is also disclosed.

10 Claims, 1 Drawing Sheet

SILICONE MIXTURE AND METHOD OF USING IT

This application is a continuation-in-part of Ser. Nos. 330,008 and 329,927 filed Mar. 29, 1989, now U.S. Pat. No. 4,906,308 and 4,910,361, respectively, the disclosures of which are expressly incorporated herein by reference.

BACKGROUND OF THE INVENTION

This application, in general, relates to an improved silicone mixture and more particularly to an improved silicone rubber mixture having clay as an additive.

Silicone compounds, and in particular silicone rubbers, have been widely used in various environments. They are often used as insulating materials and in making various components. In general, the prior art silicone compounds have proved dissatisfactory since they are not as durable as some other materials. The prior art silicone compounds may often be easily abraded or torn.

On the other hand, silicone is known to have many desirable features. Silicone has good thermal characteristics that make it a desirable insulator for both electricity and heat. In addition, a silicone compound will produce a less toxic smoke when burned than most other prior art materials, such as nylon.

For this reason, it is desired to create an improved silicone mixture that will be more resistant to abrading and more durable than the prior art silicone compounds.

SUMMARY OF THE INVENTION

The present invention discloses an improved silicone mixture that resists abrading, is resilient, and is useful as material for insulation or forming various components.

In a disclosed embodiment of the present invention, the silicone mixture consists of a first known silicone compound that is mixed with a quantity of dried pulverized clay in order to result in a more flexible material that will provide better abrasion resistance to the final silicone mixture.

In a preferred embodiment of the present invention, the silicone compound is mixed with a dried pulverized clay and a quantity of powdered alumina-trihydrate is added to provide better burn resistance.

In one embodiment, a liquid silicone rubber is utilized as the silicone compound that is mixed with the clay. An example of a silicone rubber that may be utilized is available under the tradename Silastic TM, available from Dow Chemical Company. This product consists of two compounds that are combined to initiate the setting up or curing of the product and is fully described in U.S. Pat. No. 3,445,420 entitled "Acetylenic Inhibited Platinum Catalyzed Organopolysiloxane Composition" issued to Kookoosedes, et al. In the first embodiment this silicone rubber is mixed with a clay that is dry, pulverized, and then sifted until very fine.

A particular clay that is utilized in a preferred embodiment consists of the following components:

20 to 30% Illite
10 to 15% Vermiculite
10 to 15% Kaolimite
10 to 15% Quartz
less than 5% Feltspars
5 to 10% Calcite
10 to 15% Dolomite These are the volume percentages of the various materials found in the dry clay and not the original moist clay.

In one example, Silastic TM compound, weighing 1.84 pounds per pint was mixed with clay weighing 1.24 pounds per pint. A compound was arrived at by mixing 60% by volume of the Silastic TM compound and 30% by volume of the dry sifted clay with 10% by volume of the alumina-trihydrate.

The clay, the alumina-trihydrate and the two compounds that make up the Silastic TM compound were mixed and stored in a container that was maintained at 0° F. for at least 24 hours. A vacuum was continuously applied to the container to remove air bubbles. The mixture was then ready for use.

A second embodiment of the mixture is formed by using a vulcanizing silicone rubber as the silicone compound. A silicone rubber sold under the tradename Sylgard TM and available from Dow Chemical Company, may be utilized in this second embodiment. The same clay utilized in the first embodiment is preferably utilized in the second embodiment. The Sylgard TM compound weighed 1.26 pound per pint.

The second embodiment of the mixture was arrived at by mixing 80% by volume of the Sylgard TM compound, 15% by volume of the dry sifted clay and 5% by volume of the alumina-trihydrate.

In preparing this second embodiment, the powdered clay and the powdered alumina-trihydrate are initially mixed. A small percentage of the Sylgard TM compound is then stirred into the powders to create a paste. The remainder of the Sylgard TM compound is then slowly stirred into the mixture. This mixture is exposed to some means for maintaining circulation while it is stored to prevent it from setting up.

The two mixtures are particularly advantageous for use as electric wire insulation and in particular for the outer insulating cover of electric cable. The mixtures may be coated upon the outer periphery of electric cable by a coating section that can consist of a series of chambers that each have the mixture circulating and a heated cable being drawn through the chamber. The coating will set-up on the cable due to the difference in temperature between the cable and the mixtures.

As should be clear this improved silicone mixture of this invention will have numerous other applications wholly outside electric insulator application. For instance, it is useful in forming floor tile or the like.

These and other features and objects of the present invention can be best understood from the following specification and appended drawings of which the following is a brief description thereof.

DETAILED DESCRIPTION OF THE PREFERRED EMBODIMENT

Figure 1:
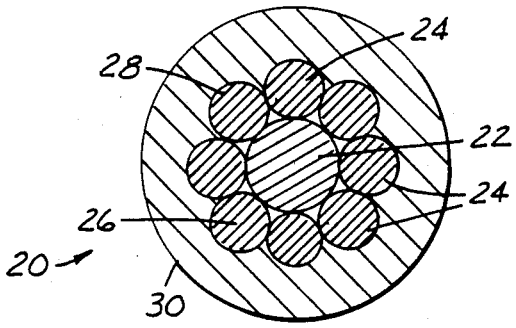
FIG. 1 shows an electric cable that may utilize the improved silicone mixture of the present invention.

The present invention discloses an improved silicone mixture in which a base silicone compound is mixed with a dry pulverized clay to form a final mixture that is more resistant to abrasion and more durable than ordinary silicone compounds.

In one embodiment, a liquid silicone rubber is mixed with dry pulverized clay, and optionally, a quantity of alumina-trihydrate to provide better fire resistance.

The liquid silicone rubber that it utilized in this first embodiment may, for example, be Silastic TM, available from Dow Chemical Company. Silastic TM consists of two compounds that are combined to initiate the setting up or curing of the final product. Silastic TM is described in U.S. Pat. No. 3,445,420 entitled "Acetylenic Inhibited Platinum Catalyzed Organopolysiloxane Composition", issued to Kookoosedes, et al.

Although it is preferred that dried pulverized sifted clay is mixed with the silicone compound, it is envisioned that an unrefined clay may also be utilized.

The clay that was utilized to make an example of the improved silicone compound consists of the following components;

20 to 30% Illite
10 to 15% Vermiculite
10 to 15% Kaolimite
10 to 15% Quartz
less than 5% Feltspars
5 to 10% Calcite
10 to 15% Dolomite These are volume percentages measured from the dried sifted clay and not the original moist clay.

In making a second embodiment of the present invention, the silicone compound is a vulcanizing silicone rubber such as is available under the tradename Sylgard TM from Dow Chemical Company. Again, a powdered alumina-trihydrate may be added to increase burn resistance.

EXAMPLES

An example of the first embodiment was prepared by following the below described steps.

Silastic TM compound weighing 1.84 pounds per pint and the above identified clay weighing 1.24 pounds per pint were utilized to form the final improved silicone mixture. The final mixture contained 60% by volume of the Silastic TM compound and 30% by volume of the dry sifted clay. The final 10% of volume was powdered alumina-trihydrate which was added to improve burn resistance.

The clay, the alumina-trihydrate and the two compounds that make up the Silastic TM compound were mixed at ambient pressure and temperature. This mixing was continued until it was ensured that the four materials were all thoroughly interspersed.

The mixture was then stored in an airtight container that was maintained at 0° F. for at least 24 hours. A vacuum was applied to this container to remove any air bubbles. At the end of the 24 hours the mixture was removed and was ready for use.

An example of the second embodiment was also prepared. Sylgard TM which weighed 1.26 pounds per pint was mixed with the above identified clay weighing 1.24 pounds per pint. This second mixture was arrived at by mixing 80% by volume of the Sylgard TM compound and 15% by volume of the dry sifted clay. 5% by volume of alumina-trihydrate was added, again for fire resistance.

The powdered clay and powdered alumina-trihydrate were initially mixed at ambient pressure and temperature. Once the two powders were thoroughly mixed, a small percentage of the Sylgard TM compound was stirred into the powders to create a paste. Once the paste had been established, the remainder of the Sylgard TM compound was stirred into the mixture. The mixture was then exposed to a means for maintaining circulation while the mixture was stored. The means for maintaining circulation prevented the mixture from setting up.

The improved silicone mixtures arrived at by the above two procedures have utility as electrical insulation materials.

FIG. 1 illustrates a cross-section of an electric cable 20 that utilizes the improved silicone mixture. A single strand of electric cable 20 has a central bare electric wire conductor 22 surrounded by wraps 24. An outer coating 30 of the improved silicone mixture is disposed around the wraps 24. Silicone impregnates an outer portion 28 of the wraps while an inner portion 26 remains free from silicone. By utilizing the improved silicone mixture, Applicant arrives at an improved electric cable in which the insulation will not abrade as easily as prior art cables. Also, Applicant arrives at an electric cable having a less toxic insulation that will not produce smoke as toxic as the prior art electric cable insulators.

Figure 2:
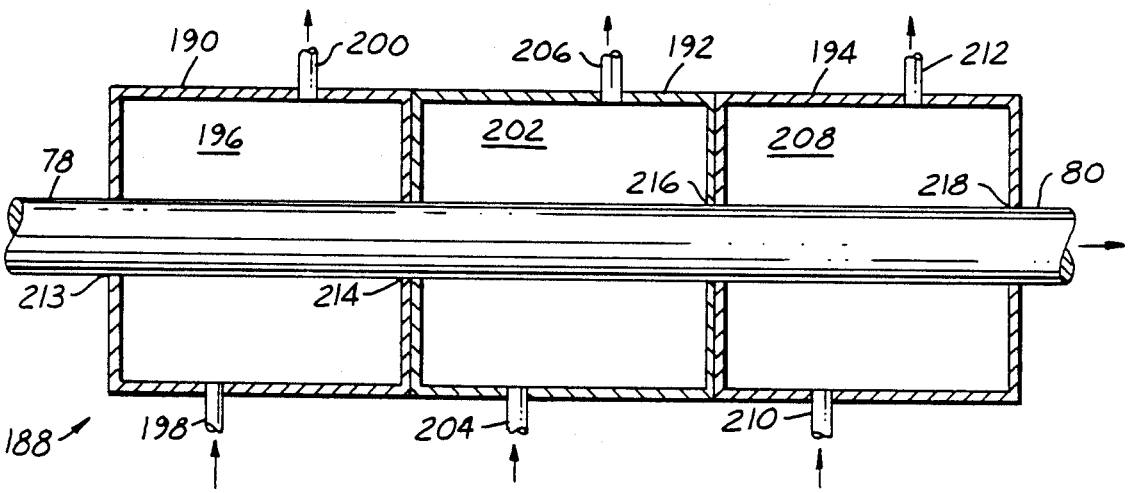
FIG. 2 shows a first embodiment of a coating section for coating the improved silicone mixture upon an electric cable.

A coating section 188 that may be utilized to coat the material upon the electric cable is illustrated in FIG. 2. This coating section 188 consists of a first coating portion 190, an intermediate cooling portion 192, and a second coating portion 194. First coating portion 190 consists of a chamber 196 that surrounds the electric cable and an inlet 198 that receives pressurized silicone mixture into chamber 196. The compound is circulated within chamber 196 to prevent it from setting up and eventually exits through exit 200.

The intermediate cooling section 192 consists of a chamber 202 that surrounds the cable and an inlet 204 that supplies cooling fluid to chamber 202. In a preferred embodiment of this invention, this cooling fluid may consist of water with an additive that has good thermal transfer characteristics, as an example, ordinary anti-freeze may be utilized. The cooling fluid circulates through chamber 202 and exists through port 206.

Second coating portion 194 has a chamber 208 surrounding the cable and a port 210 supplies the silicone mixture to the chamber 208. The fluid circulates within chamber 208 and exists through port 212.

Wire 78 enters coating portion 188 through port 213 and is coated within chamber 196. As the wire leaves chamber 196 it goes through guide port 214 separating first coating portion 190 from cooling portion 192. The size of the orifice at guide port 214 is chosen to be slightly larger than the orifice at opening 213 to accommodate the extra diameter of the wire due to the coating. As an example, it may be 0.015 inches larger in diameter.

Wire enters cooling chamber 202 through opening 215 and enters second coating portion 194. Cable is coated in second coating portion 194 and exits 80 through guide opening 218. Guide opening 218 is chosen to be slightly larger in diameter than opening 214 or 216, again to accommodate the extra diameter that the wire will now have due to the coating that has been applied in second coating portion 194.

The cable 80 is pulled through the coating section 188 by a force of approximately 150 foot pounds of tension. It is necessary to apply such a large force to pull the wire through coating section 188 since the guide openings 213, 214, 216 and 218 must be approximately the same diameter as the wire to ensure good sealing between the chamber 190, 192 and 194. Thus the improved silicone mixture of the present invention is coated onto an electric cable.

For further details of the coating of the improved silicone compound upon electric cable, and further embodiments of various types of coating sections attention is directed to the parent applications 07/330,008 and 07/329,927.

This material will have utility in a variety of applications. In particular, this material will be useful as an insulator for electric wire in all applications. In addition, this material may be useful as an insulator for welding cord and may also be useful for forming various components, such as automobile firewalls, automobile mufflers, protective clothing for fire fighters, high voltage insulated gloves, safety liners for bucket trucks doing high voltage electrical work, heat insulation pads for use in kitchens, truck bed liners and several other applications that will be obvious to one of ordinary skill in the art.

Preferred embodiments of the present invention have been disclosed, however a worker in the art would realize that certain modifications would be within the scope of this invention. Therefore, attention is directed to the following claims to determine the true scope of the present invention.

I claim:

1. A method of creating a material comprising the steps of:

(a) identifying a ratio of a vulcanizing silicone rubber, alumina-trihydrate, and a clay material;

(b) mixing the vulcanizing silicone rubber and the alumina-trihydrate; and wherein the mixture of step (b) includes initially mixing the clay and alumina-trihydrate, adding a small percentage of the vulcanizing silicone rubber to create a paste, then adding the bulk of the vulcanizing silicone rubber to create the final mixture.

2. A method of creating a material comprising the steps of:

(a) identifying a ratio of a silicone rubber, alumina-trihydrate and clay;

(b) mixing the silicone rubber, the alumina-trihydrate and the clay; and wherein the mixture of the silicone rubber, the clay and the alumina-trihydrate is placed in air tight container which is maintained at a temperature of approximately 0° F. for at least 24 hours.

3. A method as recited in claim 2, and further wherein the silicone rubber utilized in the above steps is a liquid silicone rubber.

4. A method as recited in claim 3, and further wherein the liquid silicone rubber consists of two separate compounds that are mixed to initiate the setting up of the liquid silicone rubber, the two compounds that form the silicone rubber are mixed with the clay and the alumina-trihydrate at ambient temperature and pressure.

5. A method as recited in claim 2, and wherein the air tight container is maintained at a vacuum pressure to withdraw any air bubbles from the mixture.

6. A method as recited in claim 5, and wherein the silicone mixture is disposed about an electric conductor as an insulator.

7. A method as recited in claim 5, and wherein the silicone mixture is used to form floor tile.

8. A mixture comprising:

a vulcanizing silicone rubber;

a clay material that has been dried, sifted and pulverized;

alumina-trihydrate; and said mixture contains of 80% by volume of said vulcanizing silicone rubber, 15% by volume of said dried and sifted clay material, and 5% by volume of said alumina-trihydrate.

9. A method as recited in claim 8, and wherein said mixture is utilized as an electrical insulator.

10. A mixture comprising:

a liquid silicone rubber;

a dried and sifted clay;

alumina-trihydrate; and said mixture consists of 60% by volume of said liquid silicone rubber, 30% by volume of said dry sifted clay, and 10% by volume of said alumina-trihydrate.

* * * * *